US012635760B2

(12) United States Patent
Haire et al.

(10) Patent No.: US 12,635,760 B2
(45) Date of Patent: May 26, 2026

(54) ADJUSTABLE FOOTBED AND SYSTEM

(71) Applicant: FRANKIE4 IP 1 Pty Ltd, Indooroopilly (AU)

(72) Inventors: Caroline Rose Haire, Indooroopilly (AU); Alan McCulloch, Indooroopilly (AU)

(73) Assignee: FRANKIE4 IP 1 Pty Ltd., Indooroopilly (AU)

( * ) Notice: Subject to any disclaimer, the term of this patent is extended or adjusted under 35 U.S.C. 154(b) by 0 days.

(21) Appl. No.: 18/844,579

(22) PCT Filed: Jul. 4, 2022

(86) PCT No.: PCT/AU2022/050693

§ 371 (c)(1),
(2) Date: Sep. 6, 2024

(87) PCT Pub. No.: WO2023/168479

PCT Pub. Date: Sep. 14, 2023

(65) Prior Publication Data

US 2025/0221488 A1 Jul. 10, 2025

(30) Foreign Application Priority Data

Mar. 7, 2022 (AU) ..... 2022900543
May 12, 2022 (AU) ..... 2022901267

(51) Int. Cl.

| | |
|---|---|
| ***A43B 7/142*** | (2022.01) |
| ***A43B 7/1463*** | (2022.01) |
| ***A43B 7/148*** | (2022.01) |
| ***A43B 17/02*** | (2006.01) |

(52) U.S. Cl.

CPC ..... *A43B 7/142* (2013.01); *A43B 7/1463* (2022.01); *A43B 7/148* (2013.01); *A43B 17/023* (2013.01)

(58) Field of Classification Search

CPC ..... A43B 7/1485; A43B 7/148; A43B 7/142; A43B 7/1415

USPC ..... 36/43

See application file for complete search history.

(56) References Cited

U.S. PATENT DOCUMENTS

| | | | | |
|---|---|---|---|---|
| 3,084,695 | A * | 4/1963 | O'Donnell | A43B 7/1445 36/174 |
| 7,484,319 | B2 * | 2/2009 | Cheskin | A43B 7/226 36/144 |
| 9,788,602 | B2 * | 10/2017 | Wynn | A43B 7/143 |
| 2009/0049712 | A1 | 2/2009 | Steszyn et al. | |
| 2011/0072685 | A1 | 3/2011 | Gutowsky et al. | |
| 2011/0302805 | A1 | 12/2011 | Vito | |

(Continued)

FOREIGN PATENT DOCUMENTS

| | | |
|---|---|---|
| DE | 19610981 C1 | 7/1997 |
| WO | 2015/112471 A1 | 7/2015 |

OTHER PUBLICATIONS

International Searching Authority (ISA/AU)—International Search Report and Written Opinion pertaining to International Application No. PCT/AU2022/050693 dated Aug. 19, 2022, 11 pages.

(Continued)

*Primary Examiner* — Timothy K Trieu

(74) *Attorney, Agent, or Firm* — Cesari and McKenna, LLP

(57) ABSTRACT

An adjustable footbed system comprising a removable arch support and a footbed configured to receive the removable arch support.

17 Claims, 20 Drawing Sheets

(56) References Cited

U.S. PATENT DOCUMENTS

| | | | | |
|---|---|---|---|---|
| 2017/0231318 | A1 | 8/2017 | Pedersen et al. | |
| 2021/0251335 | A1* | 8/2021 | Haire | A61F 5/14 |

OTHER PUBLICATIONS

International Preliminary Examining Authority (IPEA/AU)—International Preliminary Report on Patentability pertaining to International Application No. PCT/AU2022/050693 dated Jul. 3, 2024, 27 pages.

"Canadian Examination Report," Canadian Application No. 3,245,529, Applicant: Frankie4 IP 1 Pty Ltd, Date of Mailing: Jun. 10, 2025, pp. 1-6.

"European Supplementary Search Report," European Application No. 22930181.7-1015, Applicant: Frankie4 IP 1 Pty Ltd, Date of Mailing: May 27, 2025, pp. 1-10.

* cited by examiner

ADJUSTABLE FOOTBED AND SYSTEM

CROSS-REFERENCE TO RELATED APPLICATIONS

The present application is a national stage entry of International Application PCT/AU2022/050693 filed Jul. 4, 2022, which claims priority from AU2022900543, filed Mar. 7, 2022 and AU2022901267 filed May 12, 2022, the disclosure of each of which is hereby incorporated herein by reference in its entirety.

TECHNICAL FIELD

The present invention relates to an adjustable footbed that provides a wearer with removable and adjustable arch support. Embodiments of the invention also relate to a system allowing a wearer to adjust the level of support provided by their footwear.

BACKGROUND

Any references to methods, apparatus or documents of the prior art are not to be taken as constituting any evidence or admission that they formed, or form part of the common general knowledge.

Footwear inserts are mainly used in shoes (and are therefore also commonly referred to as shoe inserts). The inserts are removable and are placed on the insole of the shoe.

One known type of insert extends fully over the insole of the shoe to support the entire foot. This type of insert is known as a "full-insole" or "full length footbed".

Another type of insole extends only along the rear part of the shoe insole and functions to support the heel and the arch of a person's foot. This type of insert is known as a "half insole" or "half-length footbed".

It is also known to provide small inserts in the front of the shoe and these are known as "forefoot fillers".

Shoe inserts can be specially shaped or contoured to become orthopaedic inserts or orthotic insoles. These inserts function to re-align the foot into its correct position to alleviate discomfort. Such inserts are quite expensive to manufacture. Furthermore, these specially shaped or contoured inserts or insoles may not be sufficient to address a wearer's discomfort.

Making shoes comfortable to wear for long periods is a challenge. One reason is that while different people may have the same foot length, the feet can still vary in width. Thus, a foot of the same length may still be classified as a "narrow" foot, a "standard width" foot or a "wide" foot. A person's foot can also slightly change shape (e.g. slightly swell) over a day.

Comfort shoes are known which provide padding to provide comfort and support. These shoes are usually more expensive than standard shoes. A problem with these shoes is that to accommodate feet of varying widths, a large range of shoes having the same length but different widths are required which is expensive and adds to shelf space.

It is known to provide a smaller range of comfort shoes of the same length and then to provide a range of relatively expensive contoured full length inserts to accommodate feet of different widths. If a person's foot slightly swells, it becomes necessary to entirely remove one full length insert and insert another different sized full length insert to accommodate the different foot shape. This adds to the cost to the consumer and provides a relatively limited range of size variation.

A disadvantage with existing comfort shoes is that the shoe is quite large in order to fit inserts to adjust the fitting of the shoe. This makes the shoes somewhat unappealing to many potential customers.

SUMMARY OF INVENTION

In an aspect, the invention provides an adjustable footbed system comprising:

a removable arch support; and a footbed configured to receive the removable arch support.

Preferably, the footbed comprises a recess configured to receive the removable arch support, wherein the recess is complementary to the removable arch support.

Preferably, the footbed comprises multiple resilient layers. Preferably, a first resilient layer comprises latex. Preferably, the first resilient layer comprises a 3 mm latex layer having a first Shore hardness level of between approximately 17 to 19 on a type C hardness scale. Preferably, the upper surface of the footbed is comprised of the first resilient layer.

Preferably, the second resilient layer has a second Shore hardness level of between approximately 35±2 on a type C hardness scale. Preferably, the second resilient layer comprises moulded polyurethane (PU) or EVA. Preferably, the second resilient layer is located beneath the first resilient layer between the upper surface and the lower surface. Preferably, the second resilient layer is adjacent the first resilient layer between the upper surface and the lower surface. Preferably, the second resilient layer comprises a recess formed therein for receiving a removable arch support. Preferably, the recess and the removable arch support are complementarily shaped. Preferably, the arch support, when located in the recess of the footbed, sits flush with an underside or lower surface of the footbed. Preferably, the recess is located on a medial side of the footbed. Additionally, the recess is located in the midfoot region of the footbed. That is, the recess is located under an arch of a wearer when in use.

Preferably, the third resilient layer comprises an arch support located in the midfoot region of the footbed. Preferably, the arch support is removably attached to the footbed. Preferably, the arch support has a third Shore hardness level of between approximately 25 to 40 on a type C hardness scale. Preferably, the arch support comprises either ethylene-vinyl acetate (EVA) or polyurethane (PU). Preferably, the arch support has a height or thickness between approximately 1.5 mm to 2 mm. Preferably the second resilient layer is substantially located between the third resilient layer and the first resilient layer. Preferably, the arch support extends from an arch support portion of the footbed to greater than halfway across the lower surface of the footbed toward a lateral side of the footbed. Preferably, the arch support is located in the midfoot region of the footbed. Preferably, the arch support extends from a rear midfoot region of the footbed (adjacent the heel region) to the midfoot region. Preferably, the arch support extends along the continuous side wall portion between the upper surface and the lower surface of the footbed. Preferably, the arch support extends at least halfway along the continuous side wall portion between the upper surface and the lower surface of the footbed. Preferably, the footbed comprises a second arch support. Preferably, the first arch support has a first hardness and the second arch support has a second hardness. Preferably, the first hardness of the first arch support is greater than the second hardness of the second arch support.

Preferably, the footbed is configured (sized and shaped) to be removably placed within a shoe or item of footwear.

Preferably, the footbed is a full length footbed. Preferably, the full length footbed is contoured.

Preferably, the system additionally comprises a half length footbed. Preferably, the half length footbed is contoured. In some embodiments, the half length footbed is configured to receive the removable arch support. Preferably, the half length footbed includes a recess configured to receive the removable arch support, wherein the recess is complementary to the removable arch support.

Preferably, the system additionally comprises a forefoot insert arranged for insertion beneath the full length footbed.

Preferably, the system additionally comprises an item of footwear. Preferably, in use, the forefoot insert is located within the item of footwear between an interior of the item of footwear and an underside of the full length footbed. Alternatively, the forefoot insert is located within the item of footwear between an interior of the item of footwear and an upper side of the full length footbed Preferably, the removable arch support is substantially triangular. Preferably, the removable arch support is substantially fin-shaped. Preferably, the arch support is substantially triangular or fin-shaped. Preferably, the arch support includes an underside support portion connected to a side support portion. Preferably, the underside support portion extends parallel to the underside of the footbed and substantially perpendicular to the continuous side wall and is substantially triangular in shape. Alternatively, the underside support portion extends parallel to the underside of the footbed and extends at an angle (preferably an obtuse angle) relative to the continuous side wall and is substantially triangular in shape Preferably, the underside support portion includes a curved, convex edge connected to a concave edge. Preferably, the side support portion is defined by a convex edge that extends between the curved, convex edge and the concave edge of the underside support portion. Preferably, the side support portion extends substantially parallel to the continuous side wall of the footbed and substantially perpendicular to the underside of the footbed. Alternatively, the side support portion extends substantially parallel to the continuous side wall of the footbed and extends at an angle (preferably an obtuse angle) relative to the underside of the footbed.

Preferably, the arch support covers a portion of a surface of the recess.

Preferably, the removable arch support has a uniform thickness. Preferably, the underside support portion of the removable arch support has a first uniform thickness. Preferably, the side support portion of the removable arch support has a second uniform thickness. Alternatively, the side support portion of the removable arch support has a varying thickness. Preferably, the thickness of the side support portion tapers away from an end of the side support portion connected to the underside support portion.

In another aspect, the invention provides a method for providing a range of fittings and support in a shoe or an item of footwear, the method comprising:

providing a full length footbed configured to receive and cooperate with a removable arch support, a half length footbed, a forefoot insert and a removable arch support; and inserting at least one of the full length footbed and the half length footbed within a shoe or item of footwear.

In another aspect, the invention provides a method for providing a range of fittings and support in a shoe or an item of footwear, the method comprising:

providing a full length footbed configured to receive and cooperate with an arch support that is fixedly or removably located in a recess on an underside of the full length footbed, a half length footbed, a forefoot insert; and inserting at least one of the full length footbed and the half length footbed within a shoe or item of footwear.

Preferably, the method includes the additional step of providing an item of footwear or a shoe.

Preferably, the adjustable footbed system comprises a plurality of removable arch supports, wherein each removable arch support of the plurality of removable arch supports has a different density and/or hardness.

In an aspect, the invention provides an adjustable footbed system comprising: a footbed having a recess formed in an underside of the footbed configured to receive a removable arch support therein.

In an aspect, the invention provides an adjustable footbed system comprising:

an arch support; and a footbed having a recess formed in an underside of the footbed configured to receive the removable arch support therein, wherein the recess is complementary to the arch support and the arch support is fixedly or removably located in the recess.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
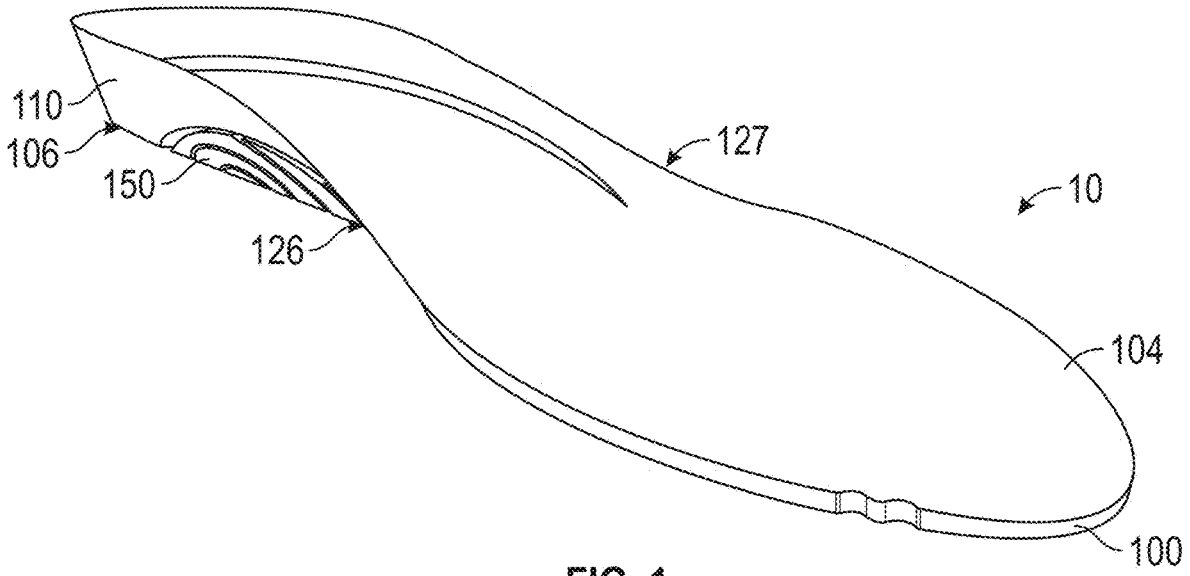
FIG. 1 illustrates an adjustable footbed having a removable arch support in accordance with an embodiment of the present invention.

Embodiments of the invention provide an adjustable footbed and footbed system to allow users to adjust and customise the amount of orthotic support provided by their footwear. The adjustable footbed includes an arch support which is removably attachable to the underside of the footbed.

A footbed 10, shown in FIGS. 1 to 5, takes the form of a flexible, resilient, integrally formed body 100 configured to receive and support an underside of a foot. The body 100 of the footbed 10 includes an upper surface 104 configured to support the underside of the foot, and a lower surface 106 opposed to the upper surface 104 located on an underside 108 of the footbed 10. The lower surface 106 is connected to the upper surface 104 by a continuous side wall portion 110. The footbed 10 is configured to receive a removable arch support 150.

The footbed 10 includes a recess 134 (described in more detail below) configured to receive the removable arch support 150, wherein the recess 134 is complementary to the removable arch support 150.

The footbed 10 includes multiple resilient layers for providing support and comfort to a wearer.

Figure 2:
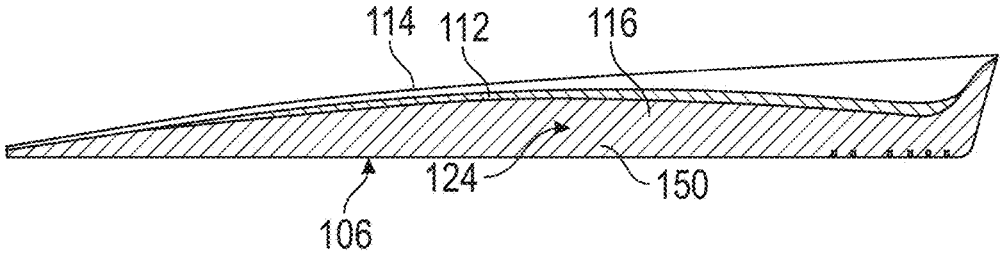
FIGS. 2 and 3 illustrate longitudinal and lateral cross-sections, respectively, of the footbed of FIG. 1.
Figure 3:
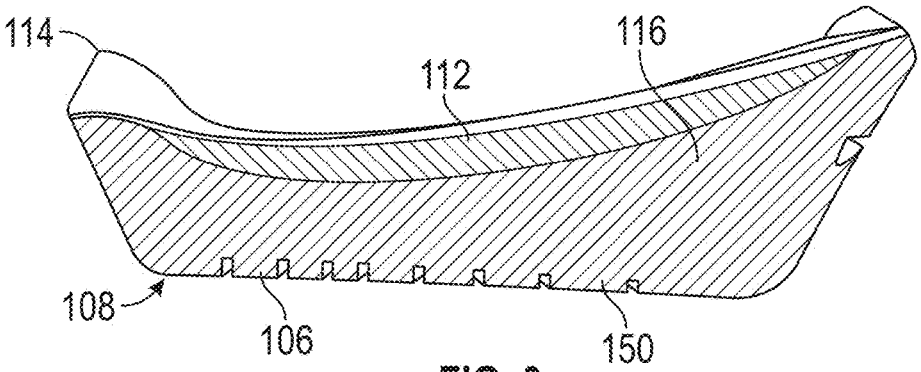

Turning to FIGS. 2 and 3, it can be seen that the illustrated embodiment includes three resilient layers. The Inventor has found that three different layers, having distinct densities provides improved support and comfort.

A first resilient layer 112 of the footbed 10 is a latex layer having a thickness or height of approximately 3 mm and a Shore hardness level of between approximately 17 to 19 on a type C hardness scale. The latex layer, combined with a thin, leather cover 114, forms the upper surface 104 of the footbed 10.

The second resilient layer 116 is made of polyurethane (but could also be made from polyurethane) and has a Shore hardness level of between approximately 35±2 on a type C hardness scale. The second resilient layer 116 is located beneath the first resilient layer 112 such that it is between the upper surface 104 and the lower surface 106.

The third resilient layer is formed by the arch support 150 located in the arch support region of the midfoot region 124 of the footbed 10 and provides additional arch support. The arch support 150 only covers a portion of the lower surface 106 of the footbed 10. The arch support 150 has a third Shore hardness level of between approximately 25 to 40 on a type C hardness scale and is made from either ethylene-vinyl acetate (EVA) or polyurethane (PU). The arch support 150 has a height or thickness between approximately 1.5 mm to 2 mm.

It should be appreciated that the arch support can be provided in a wide range of hardness levels depending on the requirements of the wearer.

Figure 4:
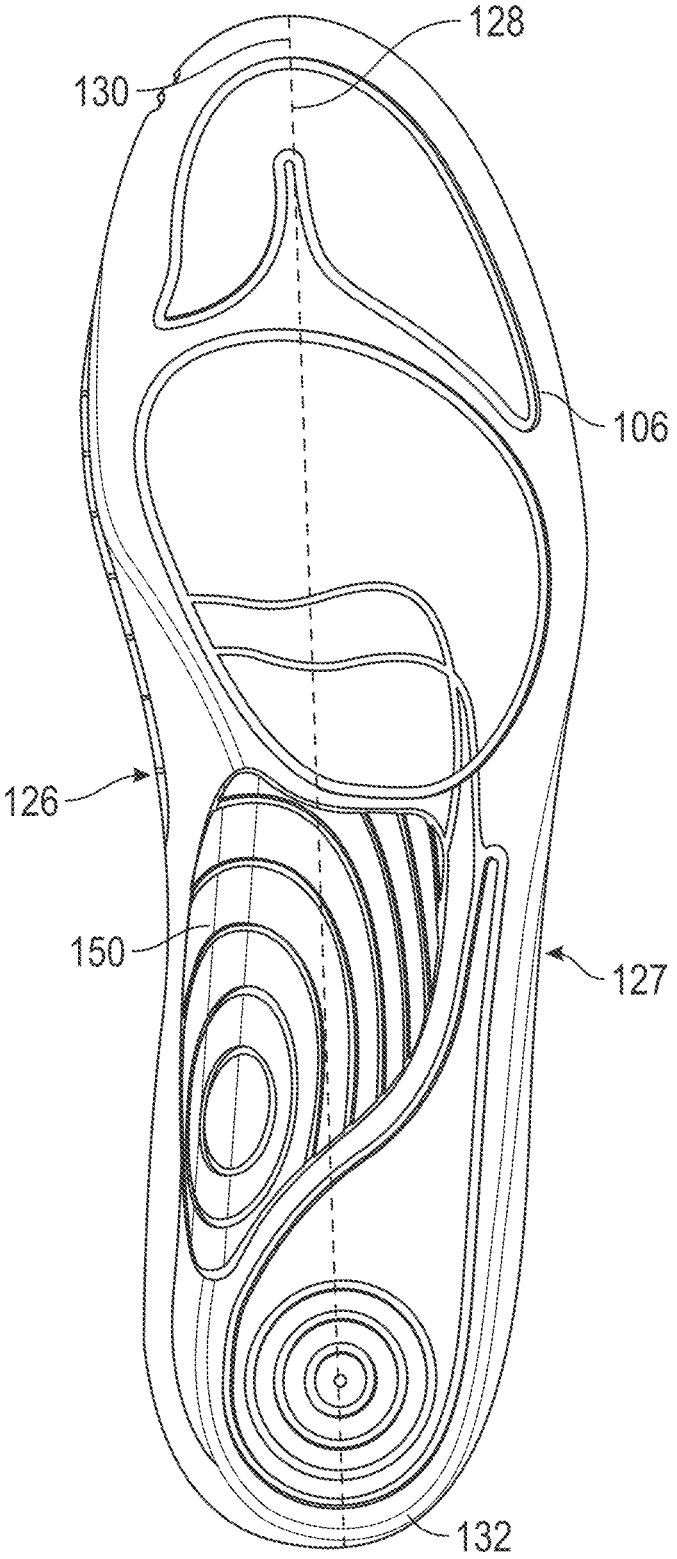
FIG. 4 illustrates the underside of the footbed showing the removable arch support attached to the underside of the footbed.

The arch support 150 extends from a medial side 126 of the footbed 10 to greater than halfway across the width of the lower surface 106 of the footbed 10 toward a lateral side 127 of the footbed 10. As illustrated in FIG. 4, the arch support 150 extends across an axis 128 of the footbed 10 extending from the centre point of the toe region 130 to the centre point of the heel region 132.

In addition, in use, the arch support 150 extends from a rear of the midfoot region 124 (adjacent the heel region 132) of the footbed 10 (adjacent the heel region 132) to the midfoot region 124. To provide additional arch support, the arch support 150 extends at least halfway between the upper surface 104 and the lower surface 106 on the continuous side wall portion 110 connecting the upper surface 104 and the lower surface 104 of the footbed 10.

Figure 5:
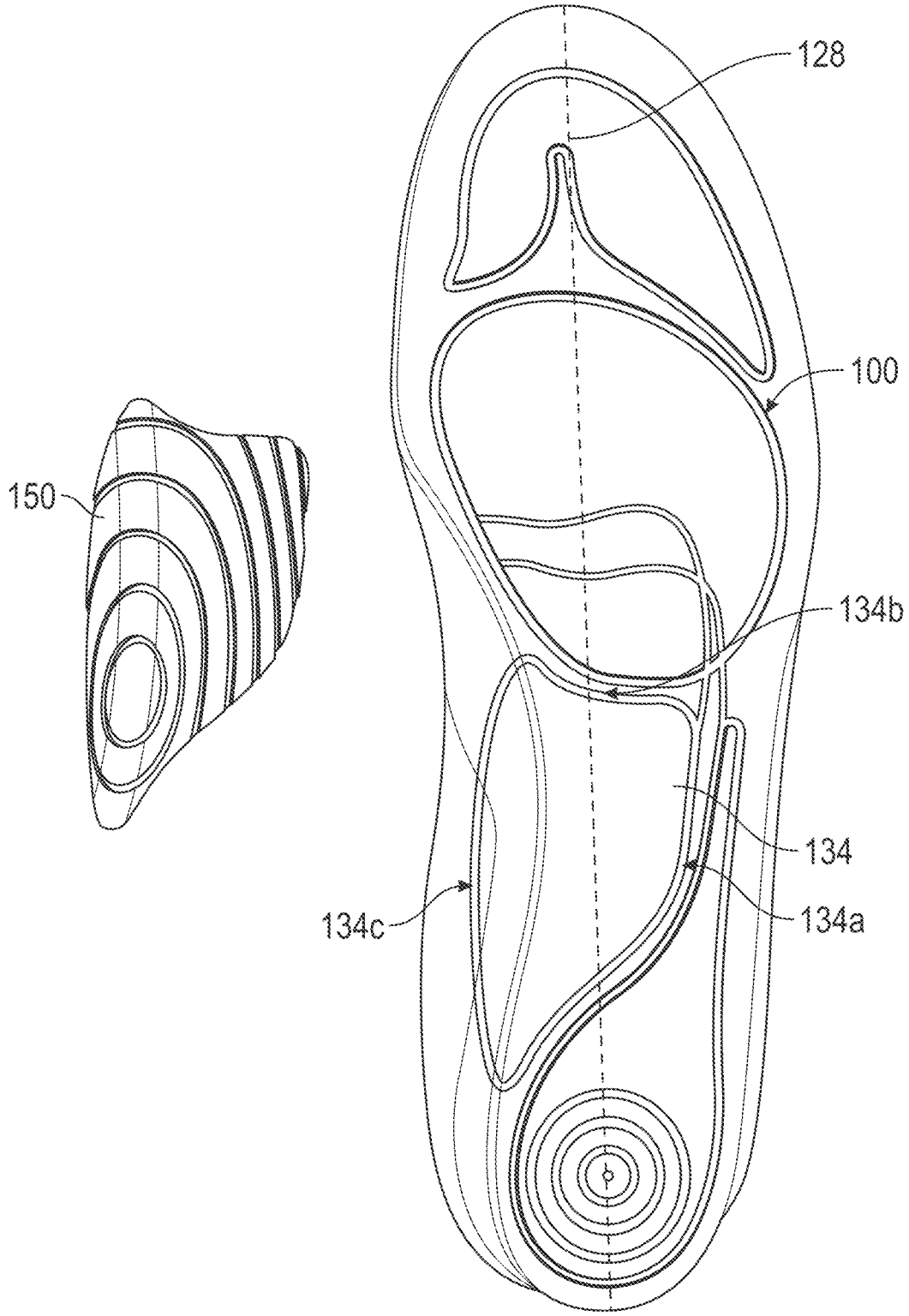
FIG. 5 shows the removable arch support detached from the footbed.

Similarly to the arch support 150, the recess 134 extends from a medial side 126 of the footbed 10 to greater than halfway across the width of the lower surface 106 of the footbed 10 toward a lateral side 127 of the footbed 10. As illustrated in FIGS. 4 and 5, the recess 134 extends across an axis 128 of the footbed 10 extending from the centre point of the toe region 130 to the centre point of the heel region 132. In addition, the recess 134 extends from a rear of the midfoot region 124 (adjacent the heel region 132) of the footbed 10 (adjacent the heel region 132) to the midfoot region 124. The recess 134 extends at least halfway between the upper surface 104 and the lower surface 106 on the continuous side wall portion 110 connecting the upper surface 104 and the lower surface 104 of the footbed 10. The recess 134 is intended to sit beneath an arch of a wearer.

The positioning of the recess 134 allows the footbed 10 to be used without a removable arch support. The recess 134 is located in an area that may be described by people as a painful area and the Inventor envisions that the location of the recess 134 may alleviate pain in this area for those with foot types who would benefit from a small reduction in thickness and contouring in the arch area. Furthermore, the recess 134 may help the rest of the plantar surface of the foot take more pressure than the arch area surface of the foot where the recess 134 is located as this area would compress under load.

Furthermore, the ability to use the footbed 10 with or without a removable arch support provides versatility to a user to comfortably use the footbed 10 in a variety of types of footwears (e.g. both sneakers and high heels). For example, in a sneaker where the heel forefoot rest in the same horizontal plane, greater arch support may be desirable or required and the footbed 10 is combined with the arch support 150 and inserted into the sneaker. However, in a high heel situation, the heel can be elevated significantly relative to the forefoot. The higher the heel sits relative to the forefoot, the less arch support required. Too much arch support when the heel is elevated can be uncomfortable and can increase the risk of an ankle sprain. In such situations, the removable arch support can be omitted or removed from the footbed 10. This allows the footbed 10 to provide a level of arch support through its contoured configuration which supports the arch but at a level that is reduced relative to that provided by the combination of the footbed 10 and the arch support 150.

As can be seen in FIGS. 4 and 5, the arch support 150 is received within a complementary recess 134 formed within the second resilient layer 116 (i.e. the PU layer) of the footbed 10. The arch support 150 may be either fixed within the complementary recess 134 or removable from within the complementary recess 134. The arch support 150 and recess 134 are configured so that the outer surface of the arch support 150 is level with or flush with the lower surface 106 (or the underside 108) of the footbed 10. That is, the recess 134 has a depth that is equal to the thickness of the arch support 150.

The recess 134 is located on the medial side 126 of the footbed 10 in the midfoot region of the footbed 10.

The footbed 10 having the complementary recess 134 can be provided without any arch support component.

Figure 11:
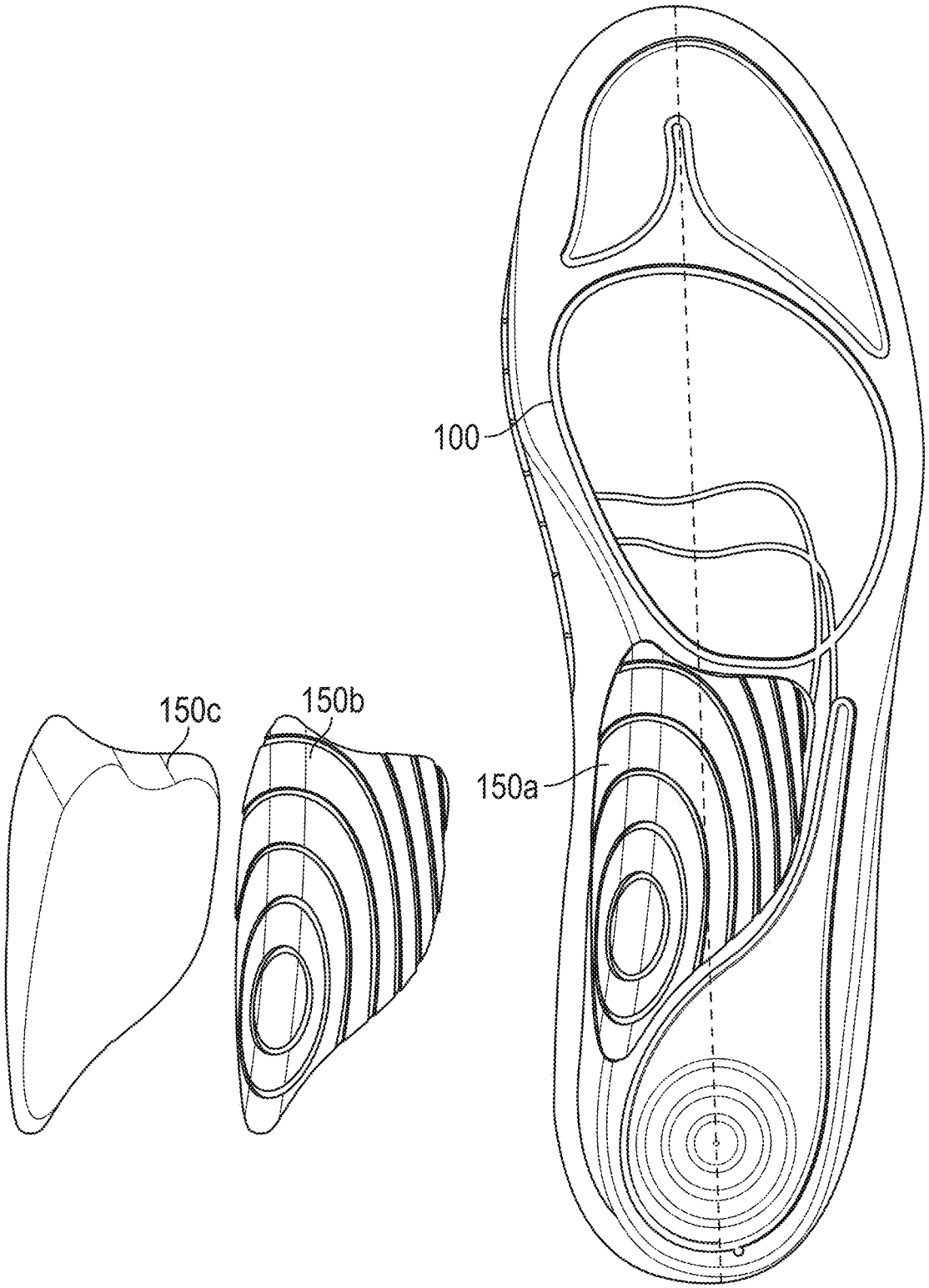
FIG. 11 shows a footbed having a plurality of removable arch supports.

In some embodiments, the removable nature of the arch support 150 allows for a greater range of support and comfort to be provided to individual wearers. For example, in an embodiment shown in FIG. 11, if a first removable arch support 150*a* with a first hardness and/or density is provided that is too rigid and hard, and the wearer desires a softer removable arch support, then the first removable arch support 150*a* can be easily removed from the footbed 10 and substituted with a second removable arch support 150*b* with a second hardness and/or density that is less than (or different) that of the first removable arch support 150*a* originally provided. A third removable arch support 150*c* could also be provided having a third hardness and/or density that is different to that of both the first removable arch support 150*a* and the second removable arch support 150*b*. This allows the multiple arch supports to provide a readily customisable level of support and comfort directly underneath the arch of a wearer without adding additional height or thickness to the footbed 10 overall, and without the need to replace the entire footbed.

Figure 6:
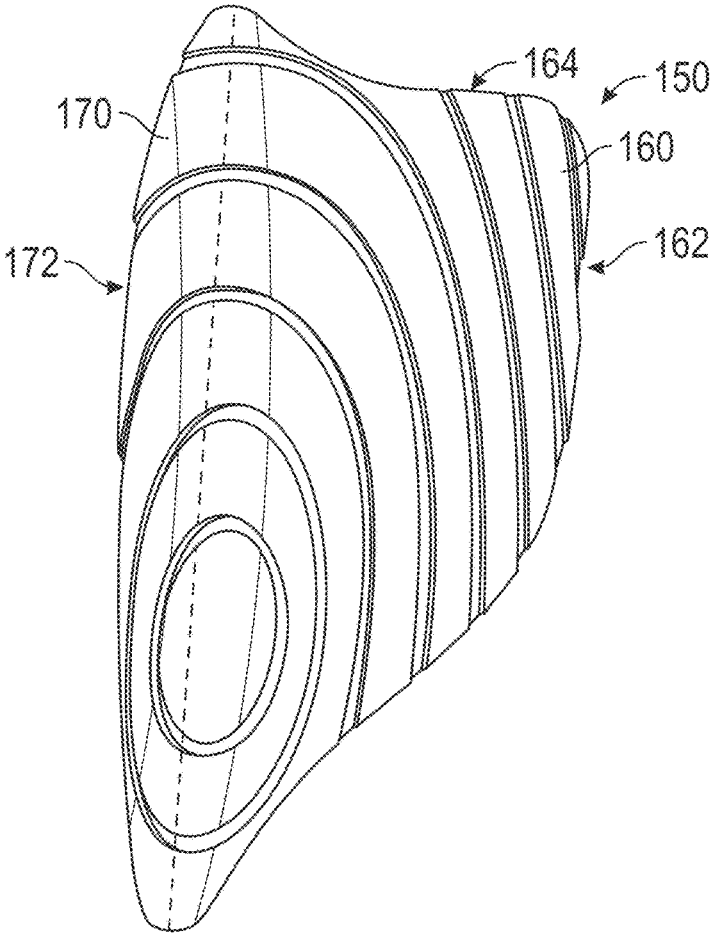
FIGS. 6 and 7 show the removable arch support.
Figure 7:
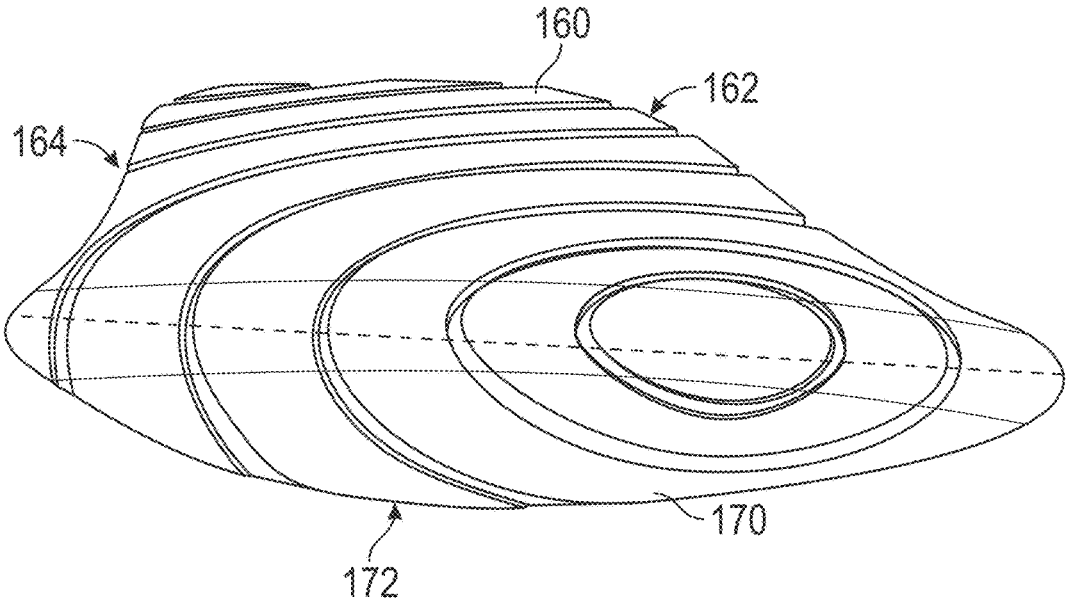

Turning to FIGS. 6 and 7, the arch support 150 is shown. The arch support 150 is substantially triangular or fin-shaped. The arch support 150 includes an underside support portion 160 connected to a side support portion 170.

The underside support portion 160 extends parallel to the underside 108 of the footbed 10 and extends at an obtuse angle relative to the continuous side wall portion 110 and is substantially triangular in shape. The underside support portion 160 includes a curved, convex edge 162 connected to a concave edge 164.

The side support portion 170 is defined by a convex edge 172 that extends between the curved, convex edge 162 and the concave edge 164 of the underside support portion 160.

The side support portion 170 extends substantially parallel to the continuous side wall portion 110 of the footbed 10 and extends at an obtuse angle relative to the underside 108 of the footbed 10. The obtuse angle is measured between the walls of the side support portion 170 and the underside support portion 160 from an inner side of the arch support 150 that abuts the footbed 10.

As described above, the recess 134 is complementary to the arch support 150 and therefore has a complementary configuration that is substantially triangular or fin-shaped. The recess 134 includes a curved, convex edge 134*a* connected to a concave edge 134*b*.

The portion of the recess 134 extending up or along the continuous sidewall portion 110 of the footbed 10 (which receives the side support portion 170 of the arch support 150) is defined by a convex edge 134*c* that extends between the curved, convex edge 134*a* and the concave edge 134*b*. The convex edge 134*c* connects to the curved, convex edge 134*a* and the concave edge 134*b* where the underside 108 of the footbed 10 connects to the continuous sidewall portion 110.

In the present embodiment, the underside support portion 160 of the arch support 150 has a uniform thickness comprising a first thickness and the side support portion 170 of the arch support 150 has a varying thickness where the thickness of the side support portion 170 tapers away from an end of the side support portion 170 connected to the underside support portion 160.

In some alternative embodiments, the arch support 150 has a uniform thickness across both the underside support portion 160 and the side support portion 170.

In some further embodiments, the underside support portion 160 of the arch support 150 has a uniform thickness comprising the first thickness and the side support portion 170 of the arch support 170 has a uniform thickness comprising a second thickness, which may be the same as the first thickness or different (either greater than or less than) to the first thickness.

In use, the increased support provided by the arch support 150, particularly in the side wall portion 110, prevents a wearer's arch from flattening, collapsing and/or overpronating, thereby supporting the arch of the wearer and reducing or eliminating problematic gait tendencies and the associated health issues that can arise from them while also ensuring that the footbed remains comfortable for the wearer. In the Inventor's experience, even if a footbed provides the necessary support to the wearer's arch, if the footbed is not comfortable then the wearer is unlikely to continue using the footbed. Thus, the footbed described herein allows the wearer to obtain the necessary support while also having a comfortable fit.

Usefully, a wearer who does not desire or require additional arch support can omit the arch support 150 entirely without compromising arch health or comfort. Thus, a wearer can quickly and easily adjust the level of support and feeling of the footbed.

Figure 8:
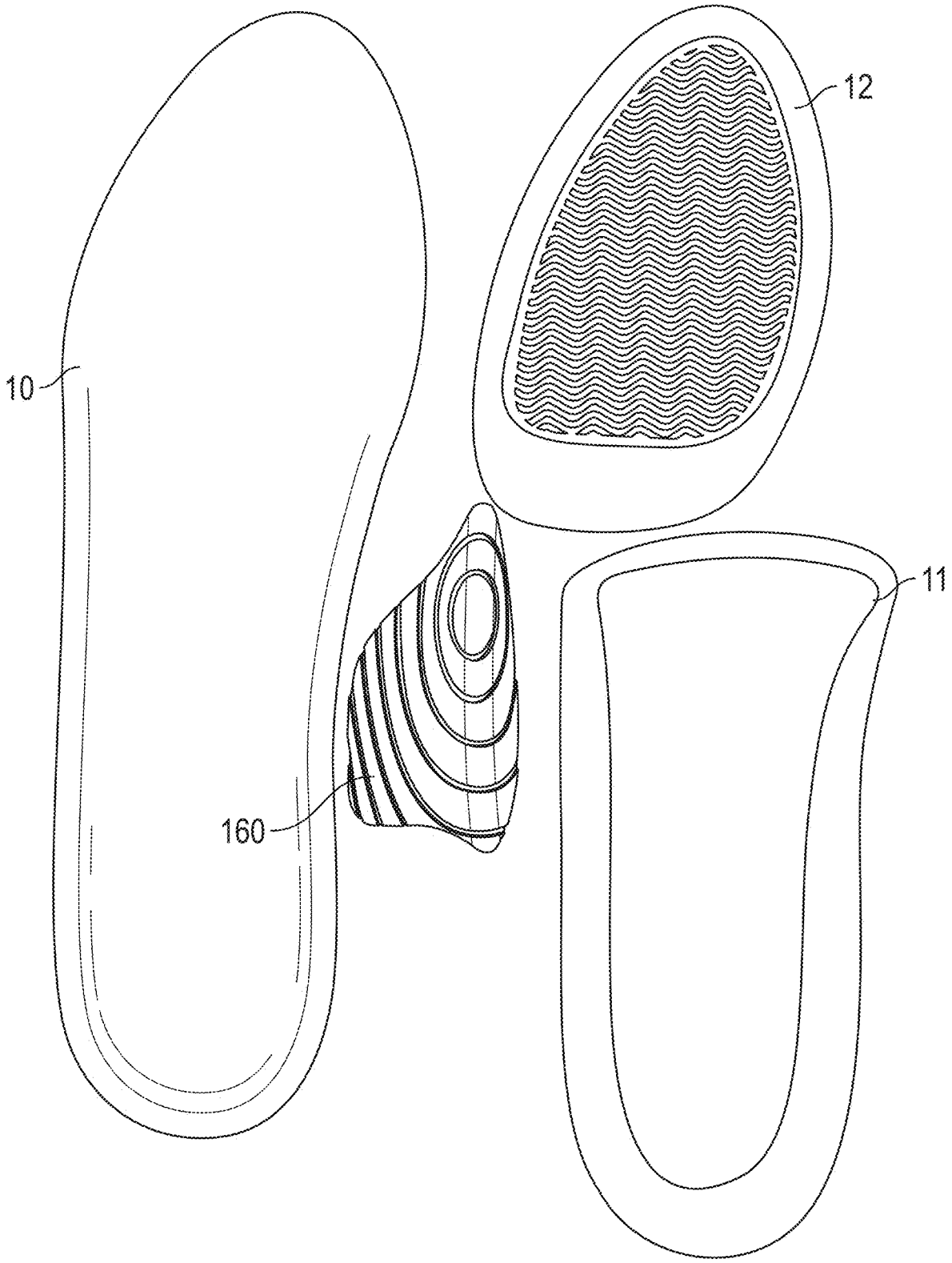
FIG. 8 shows an adjustable footbed system in accordance with an embodiment of the present invention.

In some embodiments, shown in FIG. 8, an adjustable footbed system 20 is provided having the footbed 10 (a full length footbed), a half length footbed 11 and a forefoot insert 12.

Figure 9:
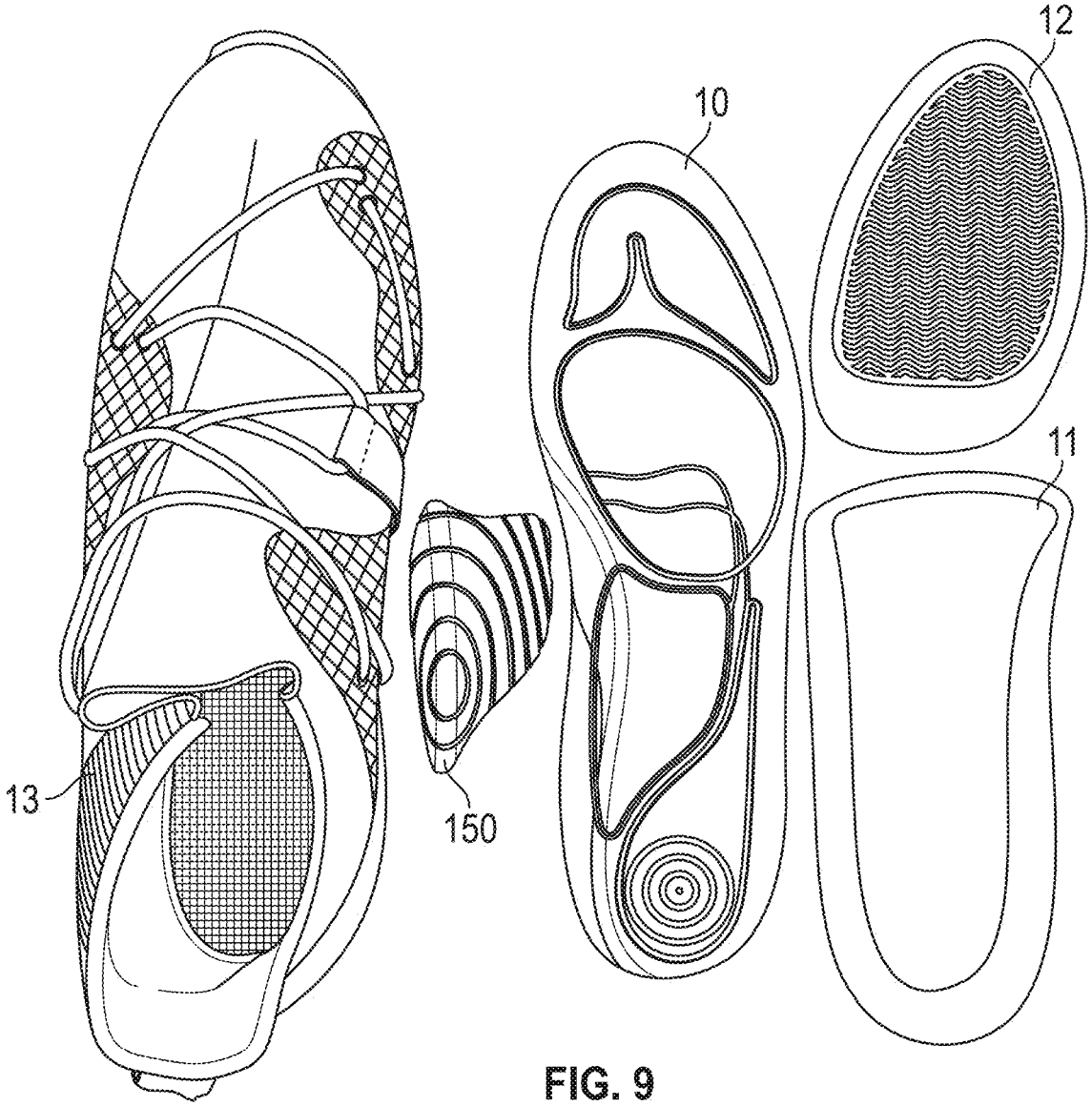
FIG. 9 shows the system of FIG. 8 with a shoe included.

In a further embodiment, shown in FIG. 9, the system 20 also includes an item of footwear in the form of a shoe 13. It will be appreciated that only a left shoe and accompanying footbeds and accessories are shown but pairs of shoes for both left and right feet can be provided.

The footbed 10 is provided for a wearer having a standard width foot.

The half length footbed 11 is provided for a wearer with a wider foot.

The forefoot insert 12 is designed to be inserted into the shoe 13 adjacent the toe portion of the footbed 10. In a preferable embodiment, the forefoot insert 12 is inserted beneath the footbed 10 such that, in use, the forefoot insert 12 sits between the interior of the shoe 13 and the underside 108 of the footbed 10 which lifts the front of the footbed 10. This creates a better fit for a wearer with narrower feet. Alternatively, the forefoot insert 12 can be placed on top of the footbed 10 so that the forefoot insert 12 sits between a wearer's foot and the footbed 10.

A footbed 30, shown in FIGS. 12 to 15, takes the form of a flexible, resilient, integrally formed body 300 configured to receive and support an underside of a foot.

The footbed 30 is configured to receive an arch support 350.

The footbed 30 includes a recess 334 (described in more detail below) configured to receive the removable arch support 350, wherein the recess 334 is complementary to the removable arch support 350.

The body 300 of the footbed 30 includes an upper surface 304 configured to support the underside of the foot, and a lower surface 306 opposed to the upper surface 304 located on an underside 308 of the footbed 30. The lower surface 306 is connected to the upper surface 304 by a continuous side wall portion 310.

In the present embodiment, the footbed body 300 is formed from a single piece of material with an additional removable resilient layer (in the form of a removable arch support) insertable into a cavity or recess formed therein. The footbed 30 may include multiple resilient layers for providing support and comfort to a wearer, as described above in relation footbed 10 shown in FIGS. 1 to 5.

As mentioned above, the footbed 30 includes a removable arch support 350 located in the arch support region of the midfoot region 324 of the footbed 10 and provides additional arch support. The arch support 350 only covers a portion of the lower surface 306 of the footbed 30. The arch support 350 has a Shore hardness level of between approximately 25 to 40 on a type C hardness scale and is made from either ethylene-vinyl acetate (EVA) or polyurethane (PU). The arch support 150 has a height or thickness between approximately 1.5 mm to 2 mm. In one embodiment, the footbed 30 is provided with two removable arch supports in the form of a first removable arch support having a first hardness and a second removable arch support having a second hardness that is different to the first hardness.

It should be appreciated that the arch support can be provided in a wide range of hardness levels depending on the requirements of the wearer.

Figure 12:
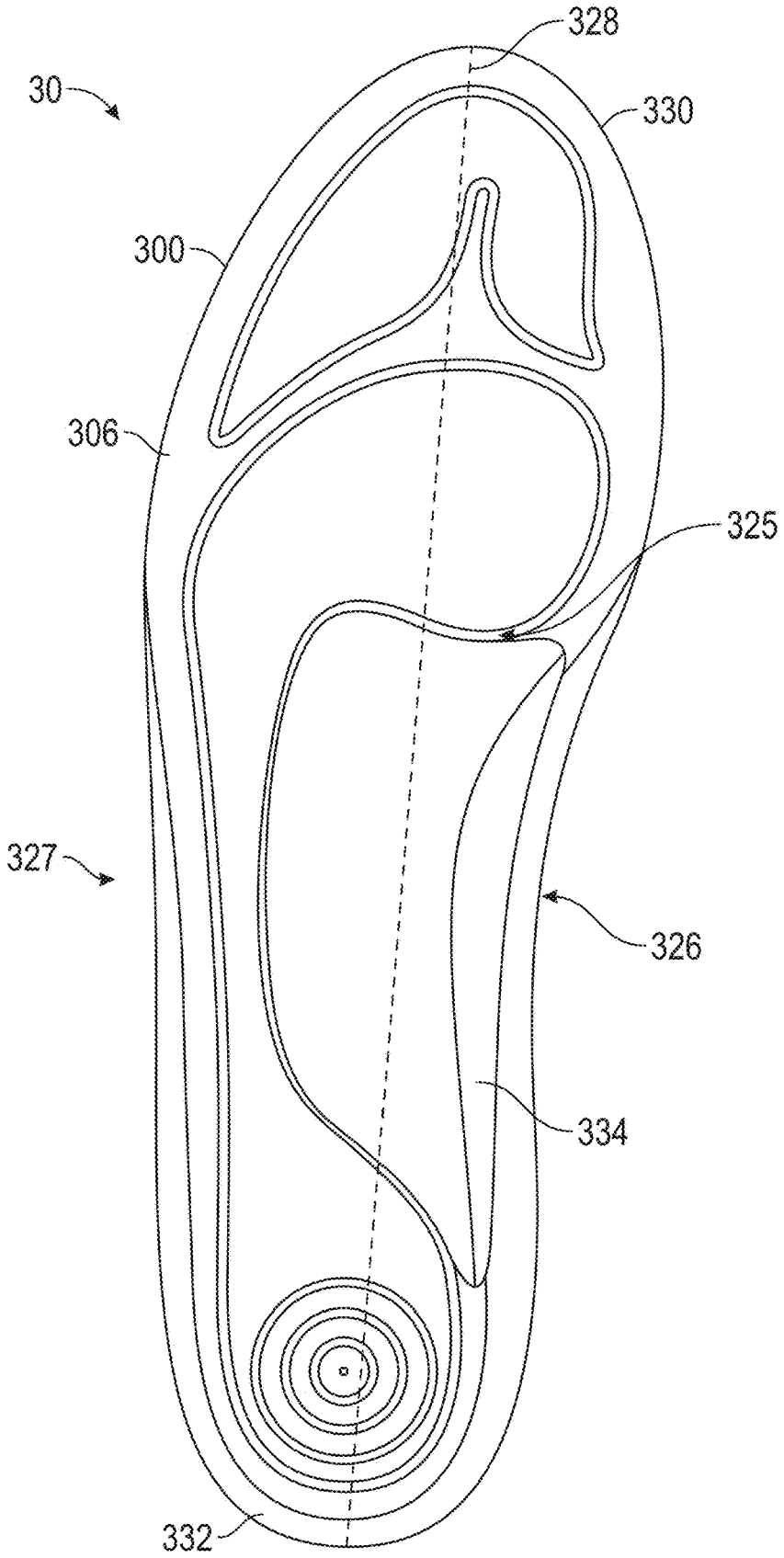
FIGS. 12 to 15 illustrate another adjustable footbed having a recess configured to receive a removable arch support in accordance with an embodiment of the present invention.

The arch support 350 extends from a medial side 326 of the footbed 30 to greater than halfway across the width of the lower surface 306 of the footbed 30 toward a lateral side 327 of the footbed 30. As illustrated in FIG. 12, the arch support 350 extends across an axis 328 of the footbed 30 extending from the centre point of the toe region 330 to the centre point of the heel region 332.

In addition, in use, the arch support 350 extends from a rear of the midfoot region 324 (adjacent the heel region 332) of the footbed 30 (adjacent the heel region 332) under the medial arch region to approximately the first metatarsal head region 325. To provide additional arch support, the arch support 350 extends at least halfway between the upper surface 304 and the lower surface 306 on the continuous side wall portion 310 connecting the upper surface 304 and the lower surface 304 of the footbed 30.

Figure 15:
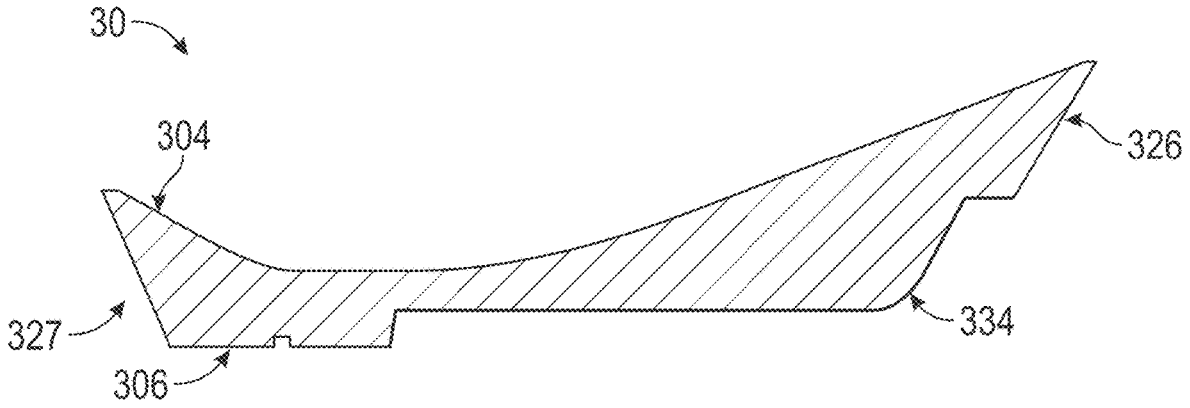

Similarly to the arch support 350, the recess 334 extends from a medial side 326 of the footbed 30 to greater than halfway across the width of the lower surface 306 of the footbed 30 toward a lateral side 327 of the footbed 30. As illustrated in FIGS. 12 and 15, the recess 334 extends across an axis 328 of the footbed 30 extending from the centre point of the toe region 330 to the centre point of the heel region 332. In addition, the recess 334 extends from a rear of the midfoot region 324 (adjacent the heel region 332) of the footbed 30 under the medial arch region to approximately the first metatarsal head region 325. The recess 334 extends at least halfway between the upper surface 304 and the lower surface 306 on the continuous side wall portion 310 connecting the upper surface 304 and the lower surface 304 of the footbed 30. The recess 334 is intended to sit beneath an arch (e.g. the medial arch) of a wearer.

The positioning of the recess 334 allows the footbed 30 to be used without a removable arch support. The recess 334 is located in an area that may be described by people as a painful area and the Inventor envisions that the location of the recess 334 may alleviate pain in this area for those with foot types who would benefit from a small reduction in thickness and contouring in the arch area. Furthermore, the recess 334 may help the rest of the plantar surface of the foot take more pressure than the arch area surface of the foot where the recess 334 is located as this area would compress under load.

Furthermore, the ability to use the footbed 30 (as with footbed 10) with or without a removable arch support provides versatility to a user to comfortably use the footbed 30 in a variety of types of footwears (e.g. both sneakers and high heels). For example, in a sneaker where the heel forefoot rest in the same horizontal plane, greater arch support may be desirable or required and the footbed 30 is combined with the arch support 350 and inserted into the sneaker. However, in a high heel situation, the heel can be elevated significantly relative to the forefoot. The higher the heel sits relative to the forefoot, the less arch support required. Too much arch support when the heel is elevated can be uncomfortable and can increase the risk of an ankle sprain. In such situations, the removable arch support can be omitted or removed from the footbed 10. This allows the footbed 10 to provide a level of arch support through its contoured configuration which supports the arch but at a level that is reduced relative to that provided by the combination of the footbed 10 and the arch support 350.

As can be seen in FIGS. 15 to 18, the arch support 350 is received within a complementary recess 334 formed within the footbed 30. The arch support 350 and recess 334 are configured so that the outer surface of the arch support 350 is level with or flush with the lower surface 306 (or the underside 308) of the footbed 30.

The recess 334 is located on the medial side 326 of the footbed 30 in the midfoot region of the footbed 30.

In the illustrated embodiment, the arch support 350 has a substantially uniform thickness across both an underside support portion 360 and the side support portion 370.

Figure 16:
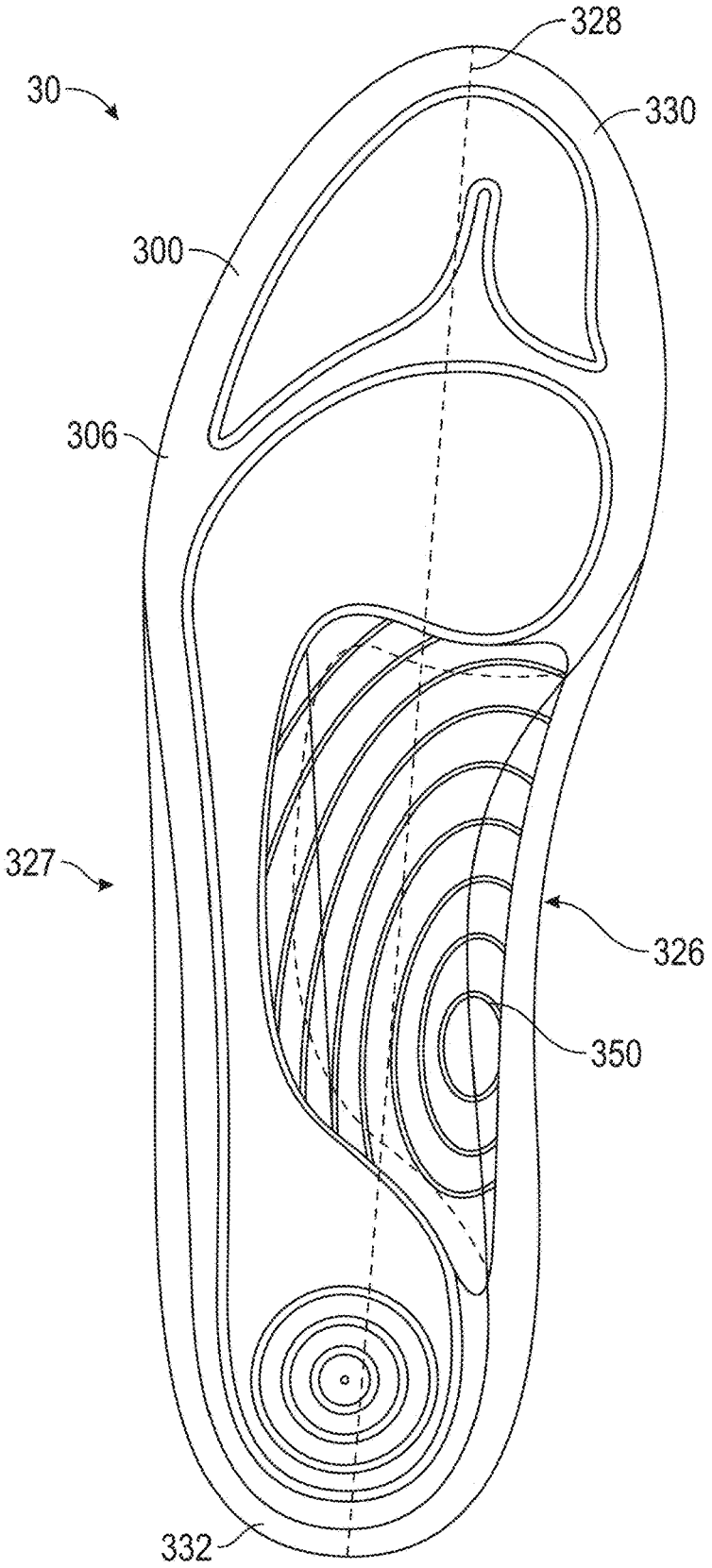
FIGS. 16 to 19 illustrate the adjustable footbed of FIGS. 12 to 15 having a removable arch support located in the recess.
Figure 17:
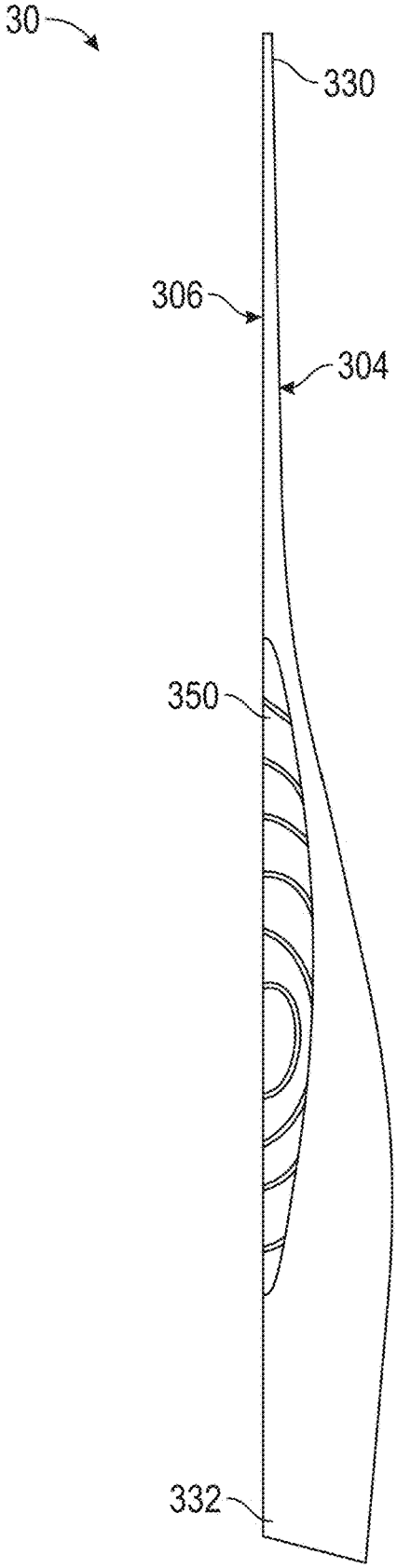
Figure 18:
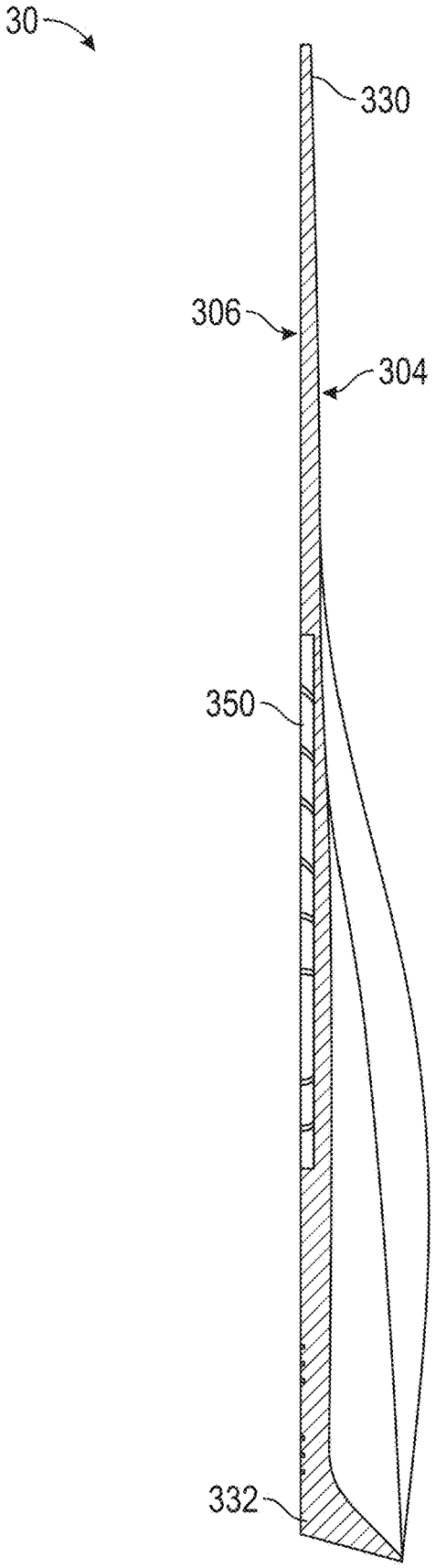
Figure 19:
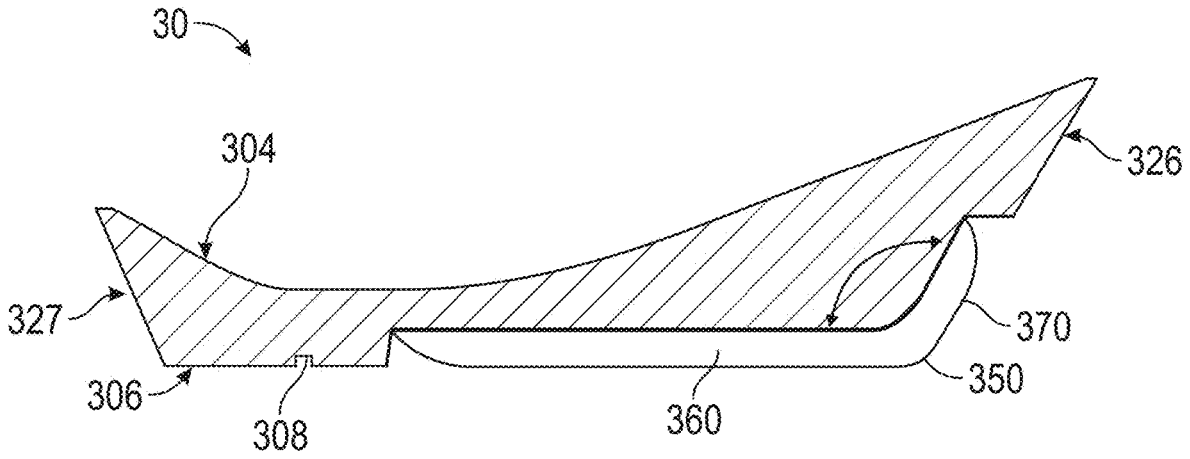
Figure 20:
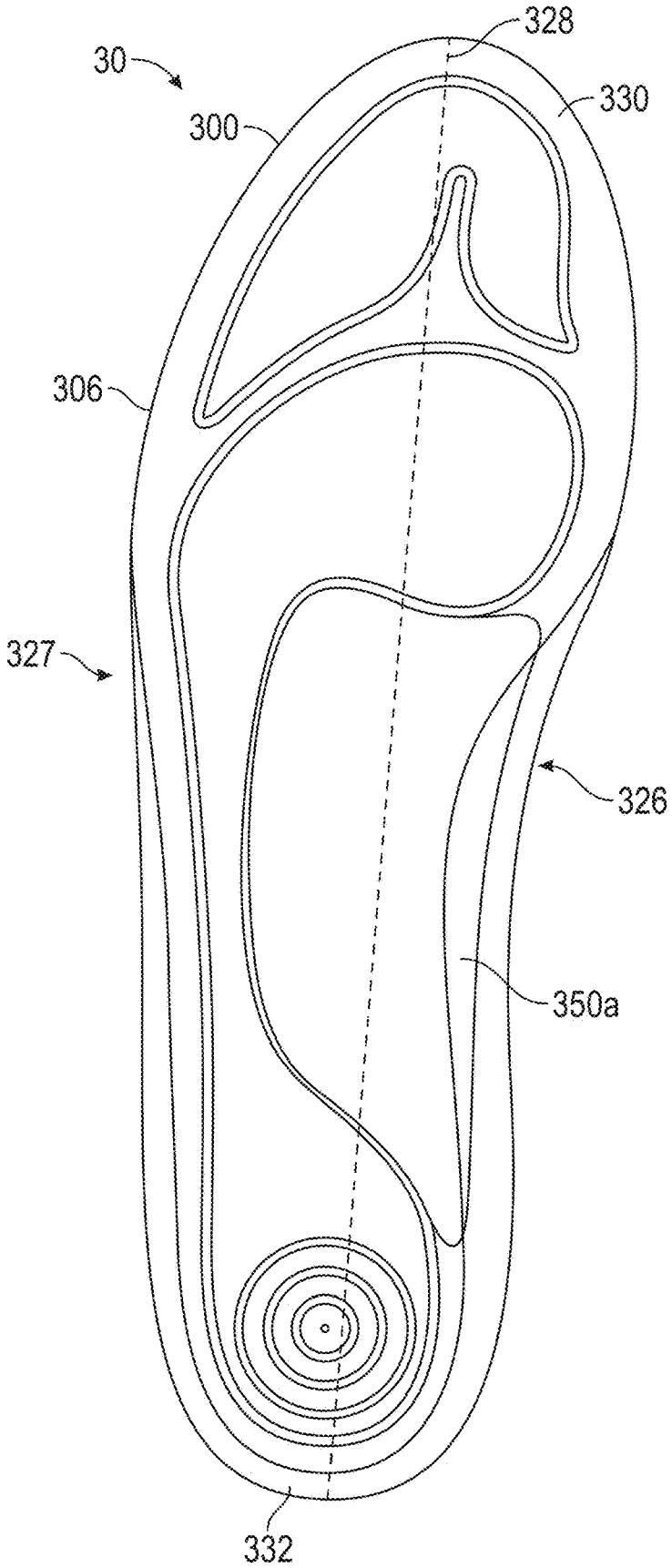
FIGS. 20 to 23 illustrate the adjustable footbed of FIGS. 12 to 15 having a different removable arch support located in the recess.
Figure 21:
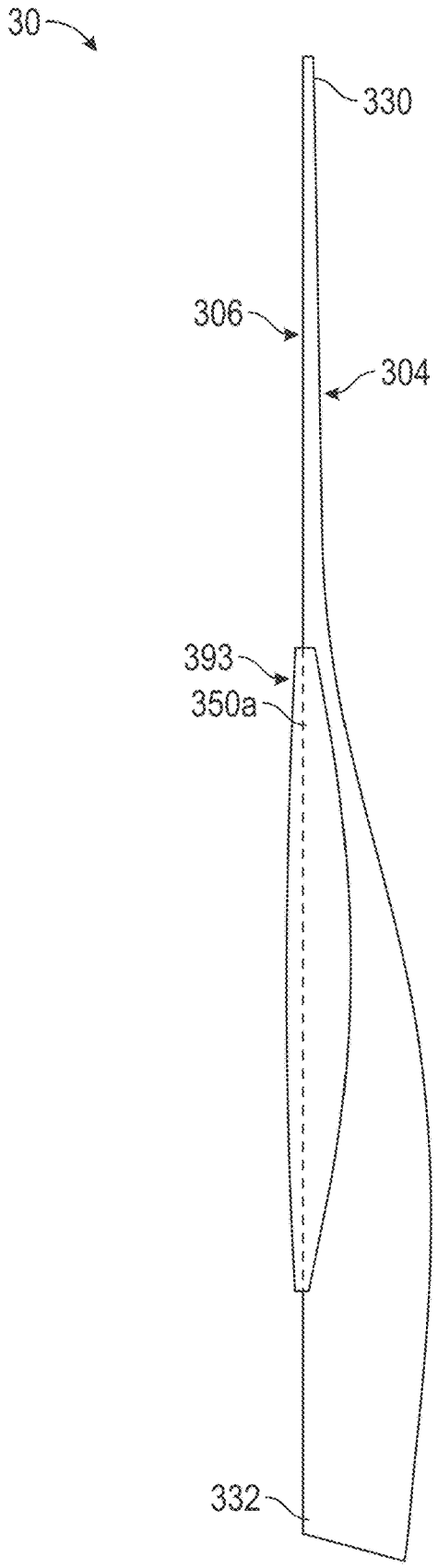
Figure 22:
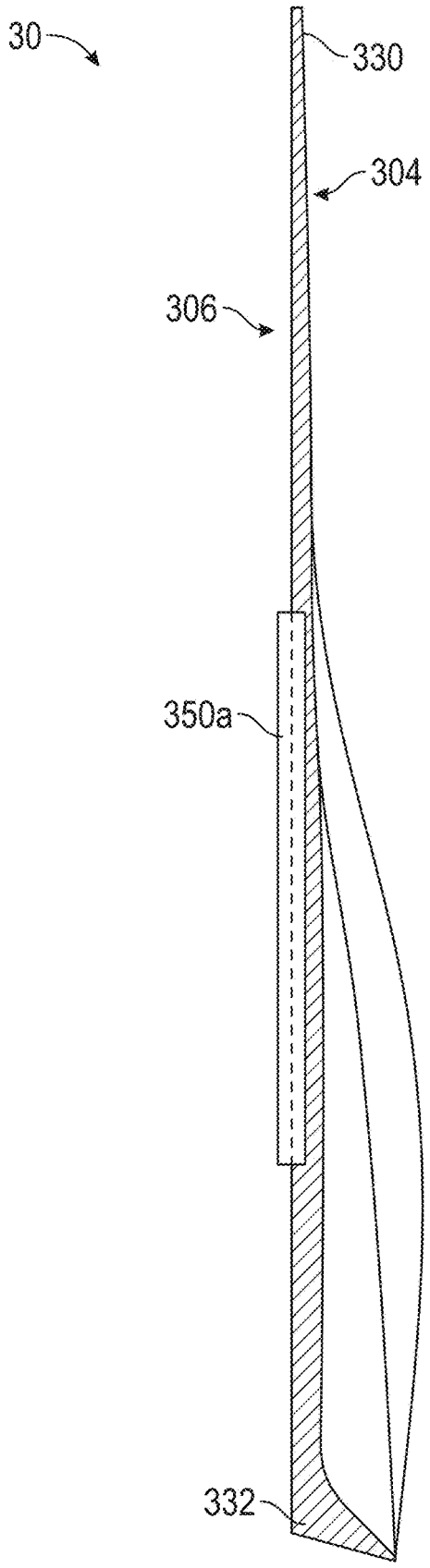
Figure 23:
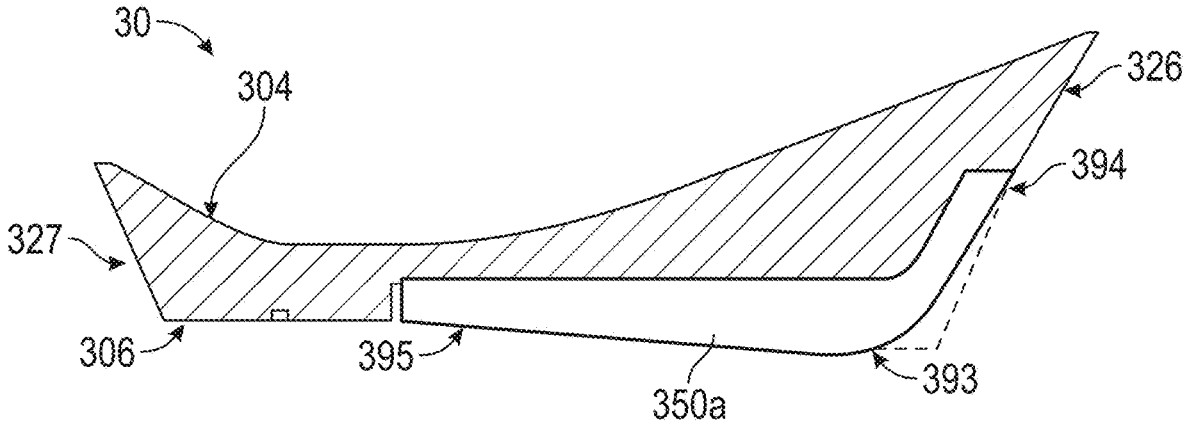

With reference to FIGS. 15, 16 and 16, the arch support 350 can be seen to be substantially triangular or fin-shaped. The arch support 350 includes an underside support portion 360 connected to a side support portion 370 mentioned above.

The underside support portion 360 extends parallel to the underside 308 of the footbed 30 and extends at an obtuse angle θ3 relative to the continuous side wall portion 310. The underside support portion 360 includes a curved, convex edge 362 connected to a concave edge 364.

The side support portion 370 is defined by a convex edge 372 that extends between the curved, convex edge 362 and the concave edge 364 of the underside support portion 360.

The side support portion 370 extends substantially parallel to the continuous side wall portion 310 of the footbed 30 and extends at an obtuse angle θ3 relative to the underside 308 of the footbed 30. The obtuse angle is measured between the walls of the side support portion 370 and the underside support portion 360 from an inner side of the arch support 350 that abuts the footbed 30.

The footbed 30 having the complementary recess 334 can be provided without any arch support component.

An additional or alternative removable arch support **350*a* may be provided. Arch support 350*a* is substantially similar to arch support 350 in that arch support 350*a* is shaped to be complementary to recess 334, such that arch support 350*a* is received within recess 334. In some embodiments, arch support 350*a* may be configured and shaped to only extend from the lower surface 306 to continuous side wall portion 310. In this manner, arch support 350*a* does not cover or fill the portion of the recess 334 located on the continuous side wall portion 310**.

Arch support **350*a* differs from arch support 350 in that arch support 350*a* has a graduated thickness such that the arch support 350*a* is at a maximum where the lower surface 306 meets the continuous side wall portion 310** on the medial side.

Arch support **350*a*** may have a hardness

Figure 13:
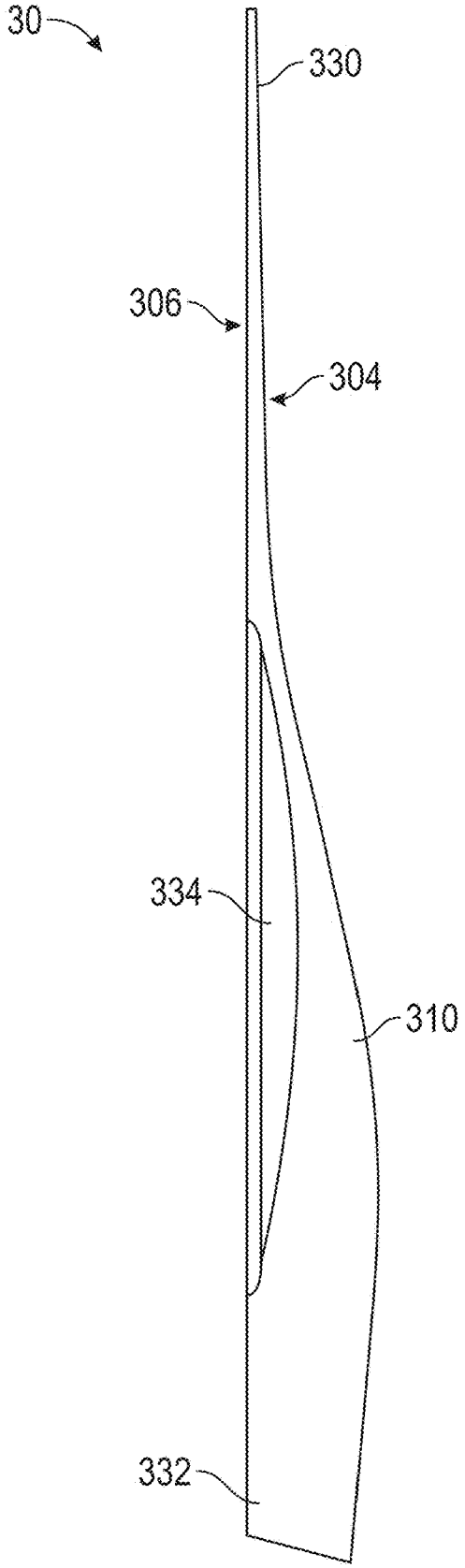
Figure 14:
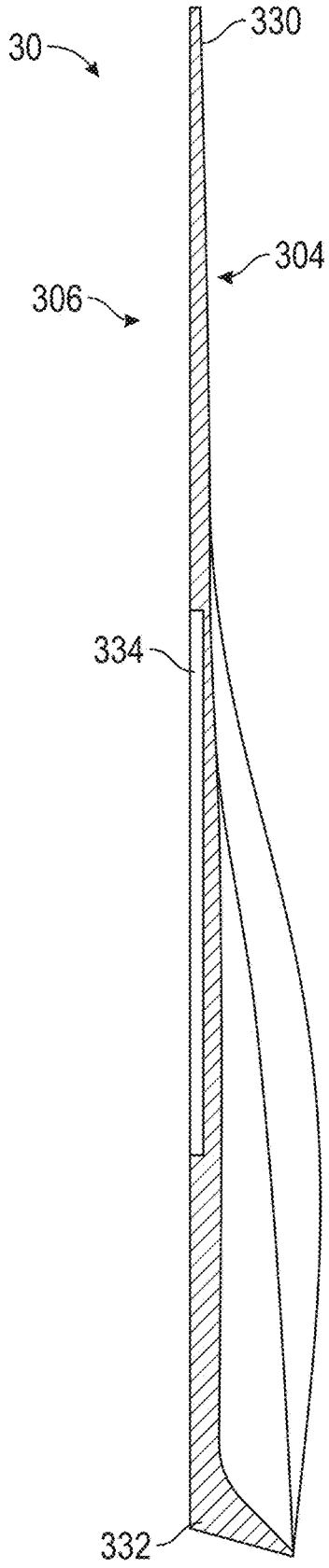

With reference to FIGS. 12 to 14, which show the arch support **350*a* attached to the footbed 30 in cross-section, it can be seen that the arch support 350*a* does not have a uniform thickness. Rather, the arch support 350*a* has a varying thickness where the thickness of the arch support 350*a* tapers gradually from a maximum thickness adjacent the medial side 326 of the footbed 30 toward the upper surface and the lateral side. In this regard, arch support 350 has a substantially uniform thickness and arch support 350***a* has a varying thickness.

Arch support 350*a*, in the illustrated embodiment, has a first thickness at a first end 394 and a second thickness at a second end 395, where the two converge to the peak 393 which has the greatest thickness.

The peak 393 is intended to sit approximately beneath the navicular bone, the highest area of the arch of a person. The maximum thickness of the arch support 350*a* is approximately 5 mm at the peak 393.

The arch support 350*a* and recess 334 are configured so that at least a portion of the outer surface of the arch support 350*a* (i.e. the peak 393) extends beyond the lower surface 306 (or the underside 308) of the footbed 30. That is, the peak 393 of the arch support 350*a* has a thickness that is greater than the depth of the recess 334.

In some embodiments, the removable nature of the arch supports allows for a greater range of support and comfort to be provided to individual wearers. For example, if a first removable arch support (having the form of arch support 350) with a first hardness and/or density is provided that is too rigid and hard, and the wearer desires a softer removable arch support, then the first removable arch support can be easily removed from the footbed 30 and substituted with a second removable arch support (having the form of arch support 350*a*) with a second hardness and/or density that is less than (or different) that of the first removable arch support originally provided. A third removable arch support (having the form of arch support 350) could also be provided having a third hardness and/or density that is different to at least one of the first removable arch support and the second removable arch support. This allows the multiple arch supports to provide a readily customisable level of support and comfort directly underneath the arch of a wearer without adding additional height or thickness to the footbed 30 overall, and without the need to replace the entire footbed. In some embodiments, the second removable arch support and the first removable arch support in the above example may have the same hardness butt different thicknesses.

The footbed 10 and the half length footbed 11 may be either "contoured" or "supportive" footbeds which provide some form of arch support through a built up arch portion in the midfoot region of the footbed, or "comfort" footbeds which do not inherently provide arch support to a wearer.

Figure 10:
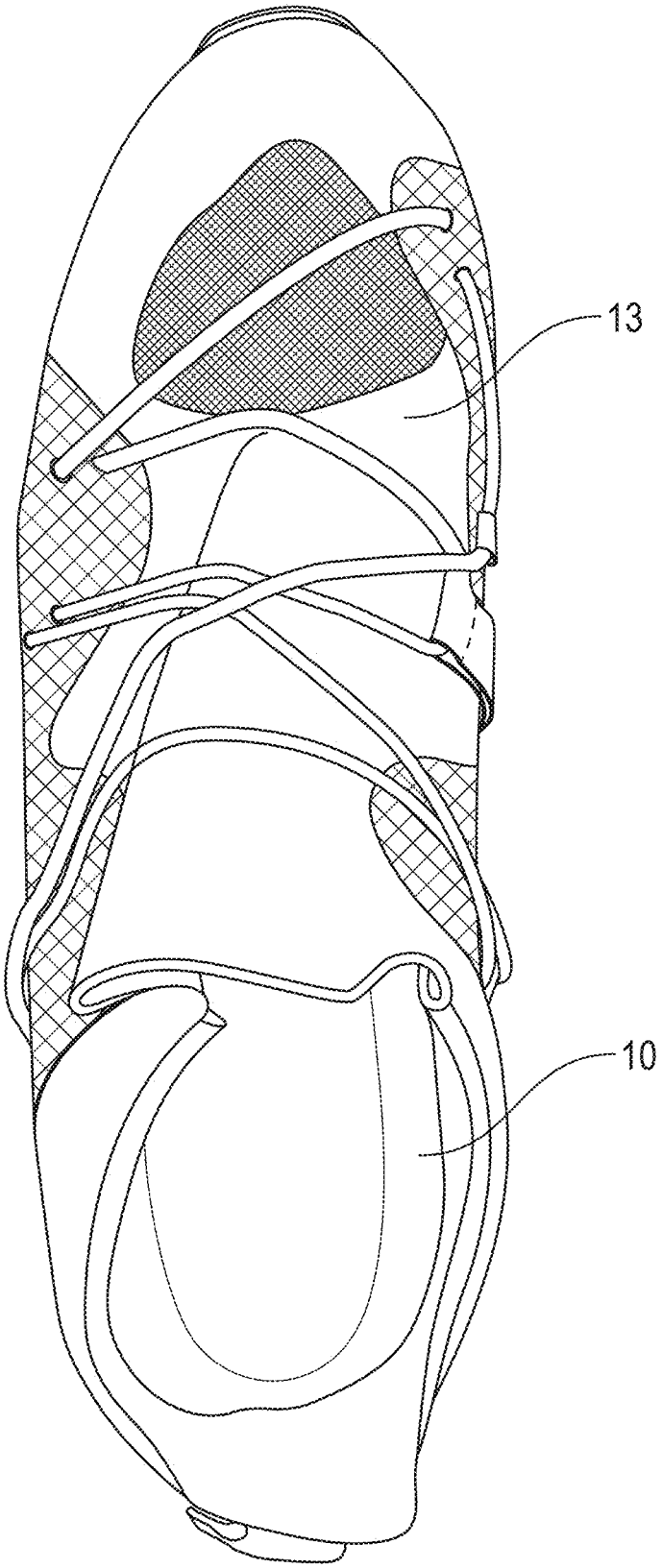
FIG. 10 shows the adjustable footbed inserted into the shoe.

In use, the wearer selects an appropriate footbed and accessory combination, where applicable, and inserts the selected footbed and accessory into the shoe 13. An example where a wearer has selected the footbed 10 having arch support 150 attached and inserted the selected combination into the shoe 13 is shown in FIG. 10.

While not shown, in some embodiments, the half length footbed is configured to receive the arch support in a recess that is complementary to the shape of the arch support.

The adjustable footbed allows a wearer to adjust the support and feel of the footbed based on individual needs and preferences. The adjustable footbed is particularly useful for users who may desire arch support under one arch but not the other. These advantages extend to the system described herein where a wearer may desire a half length footbed under one foot and a full length footbed with additional arch support under the other.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. An adjustable footbed system comprising:

a footbed having a recess formed in an underside of the footbed configured to receive one of a first removable arch support or a second removable arch support therein, wherein the recess is complementary to the first removable arch support or the second removable arch support, wherein the first removable arch support, when located in the recess of the footbed, sits substantially flush with an underside or lower surface of the footbed, wherein the first removable arch support includes an underside support portion connected to a side support portion, wherein the side support portion extends from the underside support portion at an obtuse angle, wherein the second removable arch support, when located in the recess of the footbed, sits substantially flush with an underside or lower surface of the footbed, wherein the second removable arch support includes an underside support portion connected to a side support portion, wherein the side support portion extends from the underside support portion at an obtuse angle, wherein the first removable arch and the second removable arch support are interchangeably received within the recess, wherein the first removable arch support has a first hardness and the second removable arch support has a second hardness, and the first hardness of the first removable arch support is greater than the second hardness of the second removable arch support, wherein the recess extends from a medial side of the footbed to greater than halfway across the lower surface of the footbed toward a lateral side of the footbed, and wherein the recess extends along a continuous side wall portion between the upper surface and the lower surface of the footbed.

2. The adjustable footbed system of claim 1, wherein the recess extends from a midfoot region of the footbed adjacent the heel region to the midfoot region.

3. The adjustable footbed system of claim 1, wherein the recess extends at least halfway along the continuous side wall portion between the upper surface and the lower surface of the footbed.

4. The adjustable footbed system of claim 1, wherein the first removable arch support has a Shore hardness level of between approximately 17 to 19 on a type C hardness scale and the second removable arch support has a Shore hardness level of between approximately 35±2 on a type C hardness scale.

5. The adjustable footbed system of claim 1, wherein the second removable arch support, when located in the recess of the footbed, sits substantially flush with an underside or lower surface of the footbed.

6. The adjustable footbed system of claim 1, further comprising a third removable arch support, wherein the third removable arch support is complementary to the recess and the first removable arch, the second removable arch support and the third removable arch support are interchangeably received within the recess.

7. The adjustable footbed system of claim 6, wherein the third removable arch support has a varying thickness, and the first removable arch support and the second removable arch support have a substantially uniform thickness.

8. The adjustable footbed system of claim 1, wherein the recess has a first depth.

9. The adjustable footbed system of claim 8, wherein a portion of the third removable arch support has a thickness greater than the first depth of the recess.

10. The adjustable footbed system of claim 1, wherein the underside support portion includes a curved, convex edge connected to a concave edge and the side support portion includes a convex edge that extends between the curved, convex edge and the concave edge of the underside support portion.

11. The adjustable footbed system of claim 1, wherein the first removable arch support, when located in the recess of the footbed, sits substantially flush with an underside or lower surface of the footbed such that the complete outer surface of the first removable arch support is substantially flush with a lower surface of the footbed.

12. The adjustable footbed system of claim 1, wherein the second removable arch support, when located in the recess of the footbed, sits substantially flush with an underside or lower surface of the footbed such that the complete outer surface of the second removable arch support is substantially flush with a lower surface of the footbed.

13. A method for providing a range of fittings and support, in a shoe or an item of footwear, the method comprising:

providing a full length footbed having a recess formed in an underside of the full length footbed configured to receive and cooperate with one of a first removable arch support or a second removable arch support locatable in the recess of the full length footbed, wherein the recess of the full length footbed is complementary to the first removable arch support or the second removable arch support;

a half length footbed having a recess formed in an underside of the half length footbed configured to receive and cooperate with the first removable arch support or the second removable arch support locatable in the recess of the half length footbed;

a forefoot insert and a removable arch support; and inserting at least one of the full length footbed and the half length footbed within a shoe or item of footwear, wherein the removable arch support, when located in the recess of the footbed, sits substantially flush with the underside or lower surface of the footbed, wherein the first removable arch support includes an underside support portion connected to a side support portion, wherein the side support portion extends from the underside support portion at an obtuse angle, wherein the second removable arch support, when located in the recess of the footbed, sits substantially flush with an underside or lower surface of the footbed, wherein the second removable arch support includes an underside support portion connected to a side support portion, wherein the side support portion extends from the underside support portion at an obtuse angle, wherein the first removable arch and the second removable arch support are interchangeably received within the recess, wherein the first removable arch support has a first hardness and the second removable arch support has a second hardness, and the first hardness of the first removable arch support is greater than the second hardness of the second removable arch support, wherein the recess extends from a medial side of the full length footbed or the half length footbed to greater than halfway across the lower surface of the full length footbed or the half length footbed toward a lateral side of the full length footbed or the half length footbed, and wherein the recess extends along a continuous side wall portion between the upper surface and the lower surface of the full length footbed or the half length footbed.

14. The method of claim 13, including providing an item of footwear or a shoe.

15. The method of claim 13, including providing a third removable arch support, wherein the third removable arch support is complementary to the recess and the first removable arch, the second removable arch support and the third removable arch support are interchangeably received within the recess.

16. The method of claim 15, wherein the third removable arch support has a varying thickness, and the first removable arch support and the second removable arch support have a substantially uniform thickness.

17. The method of claim 13, including locating one of the first removable arch support and the second removable arch support in the recess of the full length footbed and inserting the full length footbed within the shoe or item of footwear.

* * * * *